US011488507B2

(12) United States Patent
Zhang et al.

(10) Patent No.: US 11,488,507 B2
(45) Date of Patent: Nov. 1, 2022

(54) POWER MANAGEMENT DEVICE AND DISPLAY DEVICE

(71) Applicants: BEIJING BOE DISPLAY TECHNOLOGY CO., LTD., Beijing (CN); BOE TECHNOLOGY GROUP CO., LTD., Beijing (CN)

(72) Inventors: Yinlong Zhang, Beijing (CN); Zhihua Sun, Beijing (CN); Shulin Yao, Beijing (CN); Wenpeng Ma, Beijing (CN); Pengfei Hu, Beijing (CN); Liangliang Zhao, Beijing (CN)

(73) Assignees: BEIJING BOE DISPLAY TECHNOLOGY CO., LTD., Beijing (CN); BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 0 days.

(21) Appl. No.: 17/275,549

(22) PCT Filed: May 19, 2020

(86) PCT No.: PCT/CN2020/091000
§ 371 (c)(1),
(2) Date: Mar. 11, 2021

(87) PCT Pub. No.: WO2021/232225
PCT Pub. Date: Nov. 25, 2021

(65) Prior Publication Data

US 2022/0122507 A1 Apr. 21, 2022

(51) Int. Cl.
*G09G 3/20* (2006.01)

(52) U.S. Cl.
CPC ..... *G09G 3/20* (2013.01); *G09G 2310/0291* (2013.01); *G09G 2320/0276* (2013.01); *G09G 2330/021* (2013.01)

(58) Field of Classification Search
CPC ..... G09G 3/20; G09G 2310/0291; G09G 2320/0276; G09G 2330/021
See application file for complete search history.

(56) References Cited

U.S. PATENT DOCUMENTS

2003/0142084 A1* 7/2003 Chang ..... H04N 5/202 345/204
2007/0040825 A1* 2/2007 Mamba ..... G09G 3/3696 345/211

(Continued)

FOREIGN PATENT DOCUMENTS

CN 101847382 A 9/2010
CN 102214432 A 10/2011

(Continued)

*Primary Examiner* — Sejoon Ahn
(74) *Attorney, Agent, or Firm* — Nath, Goldberg & Meyer; Joshua B. Goldberg

(57) ABSTRACT

The present disclosure provides a power management device, including an initial voltage input terminal, a power management circuit, and a plurality of gamma correction circuits. The initial voltage input terminal is configured to provide an initial voltage; the power management circuit includes at least one follower amplifier sub-circuit, each follower amplifier sub-circuit is configured to output a corresponding target operating voltage according to the initial voltage, a reference voltage, and a target operating voltage setting parameter; and each gamma correction circuit is configured to output a corresponding gamma correction voltage according to the initial voltage, the reference voltage, and a corresponding gamma parameter. The present disclosure further provides a display device.

17 Claims, 5 Drawing Sheets

(56) References Cited

U.S. PATENT DOCUMENTS

| | | | | |
|---|---|---|---|---|
| 2010/0060078 | A1 | 3/2010 | Shaw | |
| 2014/0063079 | A1* | 3/2014 | Lee | G09G 3/3258 345/77 |
| 2014/0160173 | A1* | 6/2014 | Lee | G09G 3/3225 345/77 |
| 2018/0197492 | A1* | 7/2018 | Guo | G09G 3/36 |
| 2020/0356205 | A1* | 11/2020 | Sun | G06F 3/04164 |
| 2020/0357321 | A1* | 11/2020 | Saito | G06F 3/167 |

FOREIGN PATENT DOCUMENTS

| | | | |
|---|---|---|---|
| CN | 104123917 | A | 10/2014 |
| CN | 106057113 | A | 10/2016 |
| CN | 109036286 | A | 12/2018 |
| CN | 109767715 | A | 5/2019 |

* cited by examiner

POWER MANAGEMENT DEVICE AND DISPLAY DEVICE

This is a National Phase Application filed under 35 U.S.C. 371 as a national stage of PCT/CN2020/091000, filed May 19, 2020, the content of which is hereby incorporated by reference in its entirety.

TECHNICAL FIELD

The present disclosure relates to the field of display devices, and in particular, to a power management device, and a display device including the same.

BACKGROUND

A power management device is an important component of a display device, and is generally configured to convert a voltage signal output by a power supply into a signal required for driving a display panel to display. At present, the power management device is redundant in structure and thus cannot meet users' demand for light electronic equipment.

SUMMARY

In one aspect of the present disclosure, there is provided a power management device, including an initial voltage input terminal, a power management circuit, and a plurality of gamma correction circuits.

The initial voltage input terminal is configured to provide an initial voltage:

the power management circuit includes at least one follower amplifier sub-circuit, each follower amplifier sub-circuit is configured to output a corresponding target operating voltage according to the initial voltage, a reference voltage, and a target operating voltage setting parameter; and each gamma correction circuit is configured to output a corresponding gamma correction voltage according to the initial voltage, the reference voltage, and a corresponding gamma parameter.

Optionally, the power management device further includes a reference voltage generation sub-circuit configured to generate the reference voltage according to the initial voltage provided by the initial voltage input terminal.

Optionally, the gamma correction circuit includes a gamma parameter register sub-circuit, a gamma correction digital-to-analog conversion sub-circuit, and a gamma correction operational amplifier:

an output terminal of the gamma parameter register sub-circuit is electrically coupled to an input terminal of the gamma correction digital-to-analog conversion sub-circuit, so as to provide a gamma setting parameter to the gamma correction digital-to-analog conversion sub-circuit;

a first reference terminal of the gamma correction digital-to-analog conversion sub-circuit is configured to receive the reference voltage, and a second reference terminal of the gamma correction digital-to-analog conversion sub-circuit is grounded, so as to allow the gamma correction digital-to-analog conversion sub-circuit to output an initial gamma analog signal according to the reference voltage and the gamma setting parameter; and an input terminal of the gamma correction operational amplifier is electrically coupled to an output terminal of the gamma correction digital-to-analog conversion sub-circuit, a first reference terminal of the gamma correction operational amplifier is electrically coupled to the initial voltage input terminal, and a second reference terminal of the gamma correction operational amplifier is grounded, so as to allow the gamma correction operational amplifier to output the gamma correction voltage according to the initial gamma analog signal and the initial voltage.

Optionally, the power management device includes 10 gamma correction circuits.

Optionally, the target operating voltage includes a semi-analog supply voltage, the target operating voltage setting parameter includes a semi-analog supply voltage setting parameter, and the at least one follower amplifier sub-circuit includes a first follower amplifier sub-circuit configured to output the semi-analog supply voltage.

The first follower amplifier sub-circuit includes a first parameter register, a first digital-to-analog conversion sub-circuit, a first operational amplifier, and a first comparator;

an output terminal of the first parameter register is electrically coupled to an input terminal of the first digital-to-analog conversion sub-circuit, so as to provide the semi-analog supply voltage setting parameter to the first digital-to-analog conversion sub-circuit;

an output terminal of the first digital-to-analog conversion sub-circuit is electrically coupled to an input terminal of the first operational amplifier, a first reference terminal of the first digital-to-analog conversion sub-circuit is configured to receive the reference voltage, and a second reference terminal of the first digital-to-analog conversion sub-circuit is grounded, so as to allow the first digital-to-analog conversion sub-circuit to output an initial semi-analog supply voltage signal according to the semi-analog supply voltage setting parameter and the reference voltage;

the input terminal of the first operational amplifier is electrically coupled to the output terminal of the first digital-to-analog conversion sub-circuit, a first reference terminal of the first operational amplifier is electrically coupled to the initial voltage input terminal, and a second reference terminal of the first operational amplifier is grounded, so as to allow the first operational amplifier to output a secondary semi-analog supply voltage signal according to the initial semi-analog supply voltage signal and the initial voltage; and a positive input terminal of the first comparator is electrically coupled to an output terminal of the first operational amplifier, a negative input terminal of the first comparator is electrically coupled to a feedback voltage terminal, a first reference terminal of the first comparator is electrically coupled to a built-in voltage input terminal, and a second reference terminal of the first comparator is grounded, so as to allow the first comparator to output the semi-analog supply voltage according to a built-in voltage provided by the built-in voltage input terminal, the secondary semi-analog supply voltage signal, and a feedback signal output from the feedback voltage terminal.

Optionally, the power management device includes 2N gamma correction circuits, N being a positive integer not less than 1, the first follower amplifier sub-circuit may further include a parameter setting sub-circuit, one input terminal of the parameter setting sub-circuit is configured to receive a user code input by a user, and the other input terminal of the parameter setting sub-circuit is configured to receive the input of one half of a sum of a value of a setting parameter corresponding to the $N^{th}$ gamma correction circuit and a value of a setting parameter corresponding to the $(N+1)^{th}$ gamma correction circuit; and an output terminal of the parameter setting sub-circuit is electrically coupled to an input terminal of the first parameter register, so as to generate the parameter used by the first parameter register according to the user code, and the value received by the other input terminal of the parameter setting sub-circuit.

Optionally, the power management device further includes an analog supply voltage circuit, which includes a boost control sub-circuit, a first boost transistor, a second boost transistor, and a third boost transistor, the first boost transistor being an N-type transistor, and the second and third boost transistors being P-type transistors.

A first electrode of the first boost transistor is electrically coupled to a pulse signal terminal, a second electrode of the first boost transistor is grounded, a gate of the first boost transistor is electrically coupled to a first output terminal of the boost control sub-circuit, and the first output terminal of the boost control sub-circuit is configured to output a first switch control signal which makes the first boost transistor operate in a switching region;

a first electrode of the second boost transistor is electrically coupled to the pulse signal terminal, a second electrode of the second boost transistor is electrically coupled to the built-in voltage input terminal, a gate of the second boost transistor is electrically coupled to a second output terminal of the boost control sub-circuit, and the second output terminal of the boost control sub-circuit is configured to output a second switch control signal which controls the second boost transistor to operate in the switching region:

a first electrode of the third boost transistor is electrically coupled to the built-in voltage input terminal, a second electrode of the third boost transistor is electrically coupled to a power output terminal, a gate of the third boost transistor is electrically coupled to a third output terminal of the boost control sub-circuit, and the third output terminal of the boost control sub-circuit is configured to provide the third boost transistor with an amplification control signal which makes the third boost transistor operate in an amplification region; and a compensation terminal of the boost control sub-circuit is electrically coupled to a compensation signal input terminal, and a fourth output terminal of the boost control sub-circuit is electrically coupled to the power output terminal, so as to allow the fourth output terminal to output the analog supply voltage under the control of the first boost transistor, the second boost transistor, the third boost transistor, a pulse signal input from the pulse signal input terminal, a built-in voltage input from the built-in voltage input terminal, and a compensation voltage input from the compensation signal input terminal.

Optionally, the target operating voltage further includes a common voltage, the at least one follower amplifier sub-circuit includes a second follower amplifier sub-circuit configured to output the common voltage, and the target operating voltage setting parameter includes a common voltage setting parameter, the second follower amplifier sub-circuit includes a common voltage parameter register, a second digital-to-analog conversion sub-circuit, a second operational amplifier, and a second comparator, an output terminal of the common voltage parameter register is electrically coupled to an input terminal of the second digital-to-analog conversion sub-circuit, so as to provide the common voltage setting parameter to the second digital-to-analog conversion sub-circuit:

a first reference terminal of the second digital-to-analog conversion sub-circuit is configured to receive the reference voltage, and a second reference terminal of the second digital-to-analog conversion sub-circuit is grounded, so as to output a primary common voltage according to the common voltage setting parameter and the reference voltage, and an output terminal of the second digital-to-analog conversion sub-circuit is electrically coupled to an input terminal of the second operational amplifier;

a first reference terminal of the second operational amplifier is electrically coupled to the initial voltage input terminal, a second reference terminal of the second operational amplifier is grounded, and an output terminal of the second operational amplifier is electrically coupled to a positive input terminal of the second comparator, so as to allow the second operational amplifier to output a secondary common voltage according to the primary common voltage and the initial voltage; and the positive input terminal of the second comparator is electrically coupled to the output terminal of the second operational amplifier, a negative input terminal of the second comparator is electrically coupled to an output terminal of the second comparator, a first reference terminal of the second comparator is electrically coupled to the initial voltage input terminal, and a second reference terminal of the second comparator is grounded, so as to allow the second comparator to output the common voltage according to the secondary common voltage and the initial voltage.

Optionally, the power management device further includes a high level generation sub-circuit including a positive charge pump and a high level generation transistor, the high level generation transistor being an N-type transistor, a first electrode of the high level generation transistor is electrically coupled to a positive drive signal terminal, a second electrode of the high level generation transistor is grounded, a gate of the high level generation transistor is electrically coupled to a first output terminal of the positive charge pump, and the first output terminal of the positive charge pump is configured to output a first control signal which controls the high level generation transistor to be in an amplification region; and the positive charge pump is further configured to output a high level signal from a second output terminal thereof under the action of the high level generation transistor and a positive drive signal input from the positive drive signal terminal.

Optionally, the high level generation sub-circuit further includes a temperature compensation controller configured to generate, according to a temperature of the high level generation sub-circuit, a temperature compensation signal which controls the high level signal output from the second output terminal of the positive charge pump.

Optionally, the power management device further includes a low level generation sub-circuit including a negative charge pump and a low level generation transistor, the low level generation transistor being a P-type transistor, a gate of the low level generation transistor is electrically coupled to a first output terminal of the negative charge pump, a first electrode of the low level generation transistor is electrically coupled to a voltage level terminal, a second electrode of the low level generation transistor is electrically coupled to a negative drive signal terminal, and the first output terminal of the negative charge pump is configured to output a second control signal which controls the low level generation transistor to be in an amplification region; and the negative charge pump is further configured to output a low level signal from a second output terminal thereof under the action of the low level generation transistor and a negative drive signal input from the negative drive signal terminal.

Optionally, the power management circuit and the plurality of gamma correction circuits are integrated in a same power management chip.

Optionally, the power management device further includes a low-dropout regulator circuit externally attached to the power management chip and configured to generate a driving voltage for driving an ultra high definition serial digital interface according to a switching signal.

Optionally, the power management device further includes a first buck chopper circuit, externally attached to the power management chip and configured to generate a first low voltage according to the initial voltage, the first low voltage being configured to supply power to a timing control chip.

Optionally, the power management device further includes a second buck chopper circuit including an internal regulator sub-circuit, a buck chopping control sub-circuit, a sixth transistor, and a seventh transistor, the sixth transistor being a P-type transistor, and the seventh transistor being an N-type transistor;

the internal regulator sub-circuit is configured to generate a voltage level according to an input voltage;

a first electrode of the sixth transistor is electrically coupled to the input voltage, a second electrode of the sixth transistor is electrically coupled to a switching signal output terminal, a gate of the sixth transistor is electrically coupled to a first output terminal of the buck chopping control sub-circuit, and the first output terminal of the buck chopping control sub-circuit is configured to output a first buck chopping control signal which controls the sixth transistor to operate in a switching operation region;

a first electrode of the seventh transistor is electrically coupled to the switching signal output terminal, a second electrode of the seventh transistor is grounded, a gate of the seventh transistor is electrically coupled to a second output terminal of the buck chopping control sub-circuit, and the second output terminal of the buck chopping control sub-circuit is configured to output a second buck chopping control signal which controls the seventh transistor to operate in the switching operation region; and the sixth transistor and the seventh transistor generate the switching signal from the input voltage under the control of the first buck chopping control signal and the second buck chopping control signal.

Optionally, a compensation terminal of the buck chopping control sub-circuit is electrically coupled to a sampling signal terminal, the sampling signal terminal is configured to sample the switching signal to regulate the first buck chopping control signal and/or the second buck chopping control signal through the sampled switching signal, so as to control a waveform of the switching signal.

In a second aspect of the present disclosure, there is provided a display device, including a display panel and a power management device. The display panel includes a pixel driving circuit configured to drive the display panel to display upon receipt of a target voltage, wherein the power management device is the above power management device provided by the present disclosure and is configured to provide the target voltage and the gamma correction voltage.

BRIEF DESCRIPTION OF THE DRAWINGS

The accompanying drawings are intended to enable further understanding of the present disclosure, and are incorporated in and constitute a part of the specification. The drawings, together with the following specific embodiments, are intended to explain the present disclosure, but do not constitute a limitation of the present disclosure. In the drawings.

DETAILED DESCRIPTION

The specific embodiments of the present disclosure are illustrated in detail below with reference to the accompanying drawings. It should be understood that the specific embodiments described herein are only intended to illustrate and explain the present disclosure, rather than limiting the present disclosure.

Figure 1:
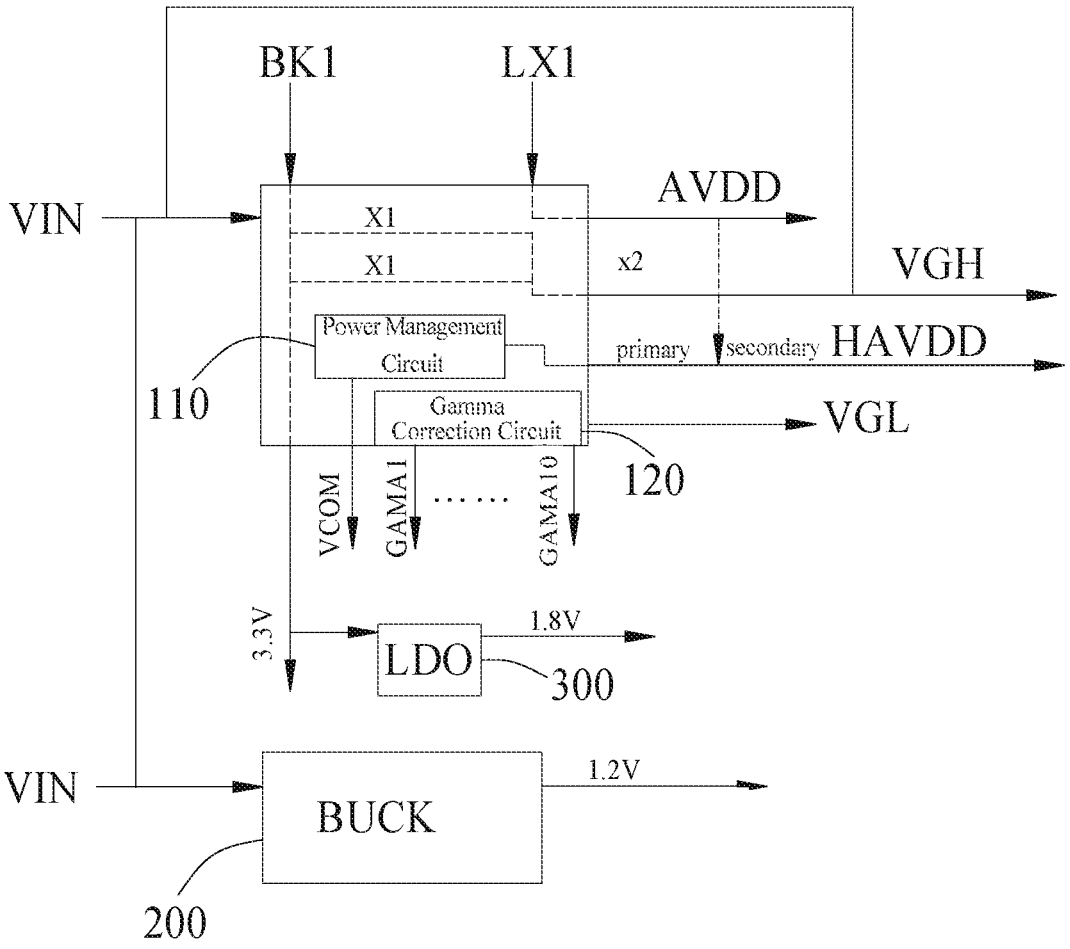
FIG. 1 is a block diagram of a power management device according to a first embodiment of the present disclosure.

In a first aspect of the present disclosure, there is provided a power management device (PMIC, power management IC). As shown in FIG. 1, the power management device includes an initial voltage input terminal VIN, a power management circuit 110, and a plurality of gamma correction circuits 120. The initial voltage input terminal VIN is configured to provide an initial voltage $V_{IN_GAMA}$.

The power management circuit 110 includes at least one follower amplifier sub-circuit, each follower amplifier sub-circuit is configured to output a corresponding target operating voltage according to the initial voltage $V_{IN_GAMA}$, a reference voltage Vref, and a target operating voltage setting parameter. Each gamma correction circuit 120 is configured to output a corresponding gamma correction voltage according to the initial voltage $V_{IN_GAMA}$, the reference voltage Vref, and a gamma parameter.

In the present disclosure, the power management circuit 110 outputs the target operating voltage through the follower amplifier sub-circuit. The follower amplifier sub-circuit has a simple circuit structure, which allows integration of the plurality of gamma correction circuits 120 in the power management circuit 110, thereby facilitating making an electronic device including the power management device small and light.

It should be noted that the power management device is applied to a display device including a display panel, and the target operating voltage and the plurality of gamma correction voltages provided by the power management device can be used to drive the display panel to display.

How to generate the reference voltage Vref is not particularly limited in the present disclosure. Optionally, the reference voltage Vref may be generated by use of the initial voltage $V_{IN_GAMA}$ provided by the initial voltage input terminal. That is, the power management device further includes a reference voltage generation sub-circuit configured to generate the reference voltage Vref according to the initial voltage $V_{IN_GAMA}$ provided by the initial voltage input terminal. As an optional implementation, the reference voltage generation sub-circuit may have a low-dropout (LDO) regulator, so as to reduce a fluctuation caused by the initial voltage $V_{IN_GAMA}$ and improve the stability of the reference voltage Vref.

The specific number of the gamma correction circuits 120 is not particularly limited in the present disclosure. For example, the number of the gamma correction circuits 120 may be determined according to specific requirements of a display panel. For example, the power management device may include 10 gamma correction circuits. However, it should be noted that, by providing 10 gamma correction circuits, it should be ensured that a finally obtained gamma curve can meet a corresponding standard.

The specific type of the target operating voltage is not particularly limited in the present disclosure. For example, the target operating voltage may be a semi-analog supply voltage (i.e. HAVDD). In the case where the display panel used together with the power management device is a liquid crystal display panel, the target operating voltage may be a common voltage VCOM.

In the related art, a power management device provides an analog supply voltage (i.e., AVDD), and a plurality of buck chopper circuits (i.e., buck circuits) need to be externally attached to the power management device so as to generate target operating voltages such as a common voltage, a semi-analog supply voltage and the like respectively by use of the analog supply voltage. Furthermore, in the related art, a programmable gamma chip needs to be externally attached to output a plurality of gamma correction voltages. As described above, the power management device in the present disclosure can output not only a plurality of gamma correction voltages but also a plurality of target operating voltages, and as compared with the related art, the present disclosure can realize various functions in the related art with a simpler structure.

Figure 2:
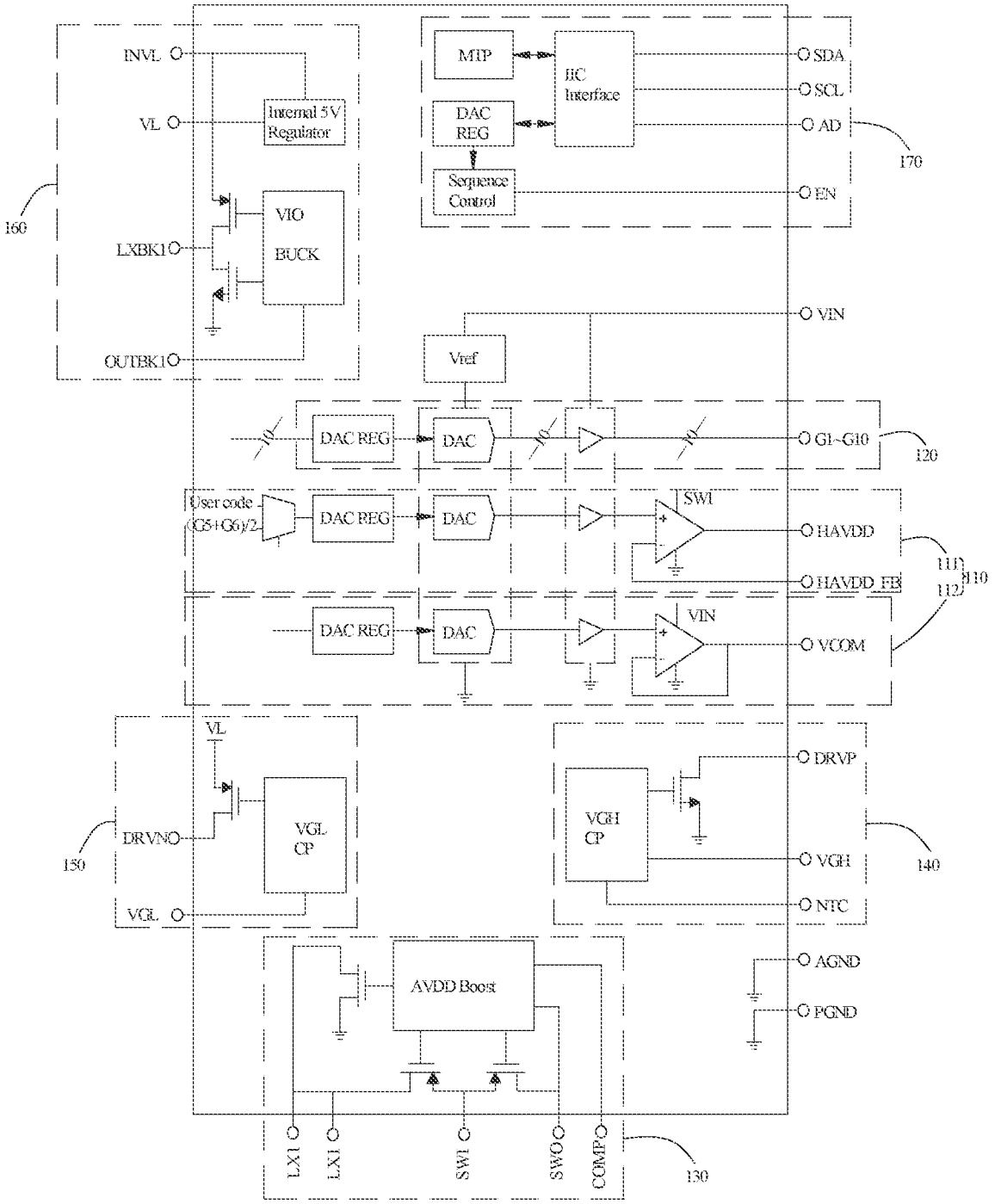
FIG. 2 is a block diagram of a power management device according to a second embodiment of the present disclosure.
Figure 3:
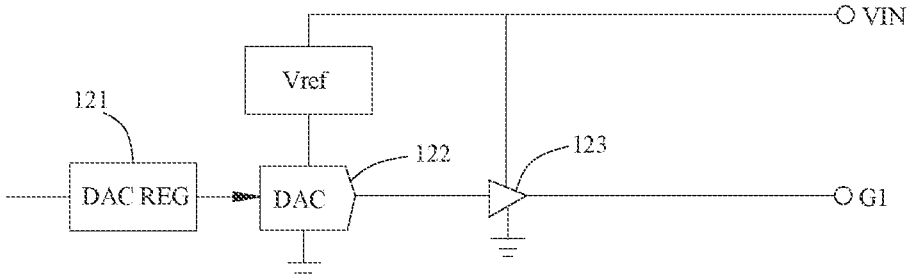
FIG. 3 is a block diagram of a gamma correction circuit in a power management device according to an embodiment of the present disclosure.

The specific structure of the gamma correction circuit 120 is not particularly limited in the present disclosure. As shown in FIGS. 2 and 3, the gamma correction circuit 120 may include a gamma parameter register sub-circuit 121, a gamma correction digital-to-analog conversion sub-circuit 122, and a gamma correction operational amplifier 123.

An output terminal of the gamma parameter register sub-circuit 121 is electrically coupled to an input terminal of the gamma correction digital-to-analog conversion sub-circuit 122, so as to provide a gamma setting parameter to the gamma correction digital-to-analog conversion sub-circuit 122.

A first reference terminal of the gamma correction digital-to-analog conversion sub-circuit 122 is configured to receive the reference voltage Vref, and a second reference terminal of the gamma correction digital-to-analog conversion sub-circuit 122 is grounded, so that the gamma correction digital-to-analog conversion sub-circuit can output an initial gamma analog signal according to the reference voltage Vref and the gamma setting parameter.

An input terminal of the gamma correction operational amplifier 123 is electrically coupled to an output terminal of the gamma correction digital-to-analog conversion sub-circuit 122, a first reference terminal of the gamma correction operational amplifier 123 is electrically coupled to the initial voltage input terminal VIN, and a second reference terminal of the gamma correction operational amplifier 123 is grounded, so that the gamma correction operational amplifier 123 can output the gamma correction voltage according to the initial gamma analog signal and the initial voltage $V_{IN_GAMA}$.

In the case where the gamma correction circuit is used to generate a gamma correction signal, a setting parameter (specifically, in the form of a digital-to-analog conversion code (DAC code)) is input to the gamma parameter register sub-circuit 121. Specifically, an output voltage of the gamma parameter register sub-circuit 121 is controlled through the DAC code, and a corresponding gamma correction voltage is finally generated by the gamma correction operational amplifier 123.

It should be noted that each gamma correction circuit 120 includes a gamma parameter register sub-circuit 121, a gamma correction digital-to-analog conversion sub-circuit 122, and a gamma correction operational amplifier 123.

In the related art, an analog supply voltage AVDD generated by the power management device needs to be output to the externally attached programmable gamma correction chip to generate a gamma correction voltage. By comparison, in the embodiment of the present disclosure, the structure that can generate the gamma correction voltage merely using the initial voltage is simpler.

As described above, the target operating voltage may include a semi-analog supply voltage HAVDD. Correspondingly, the target operating voltage setting parameter includes a semi-analog supply voltage setting parameter, and the at least one follower amplifier sub-circuit includes a first follower amplifier sub-circuit 111 configured to output the semi-analog supply voltage.

Figure 4:
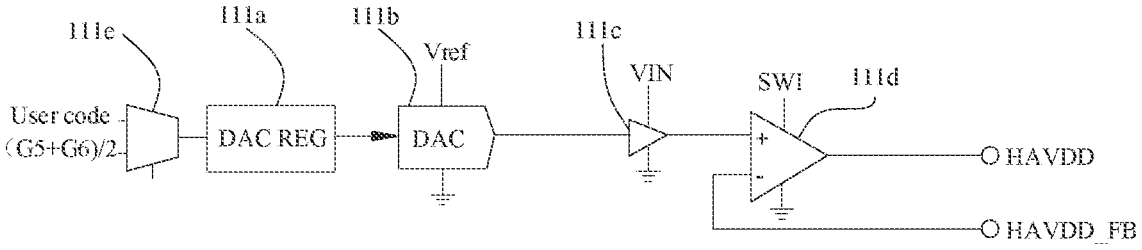
FIG. 4 is a block diagram of a semi-analog supply voltage generation sub-circuit in a power management device according to an embodiment of the present disclosure.

As shown in FIGS. 2 and 4, the first follower amplifier sub-circuit 111 includes a first parameter register 111*a*, a first digital-to-analog conversion sub-circuit 111*b*, a first operational amplifier 111*c*, and a first comparator 111*d*.

As shown in FIG. 4, an output terminal of the first parameter register 111*a* is electrically coupled to an input terminal of the first digital-to-analog conversion sub-circuit 111*b*, so as to provide the semi-analog supply voltage setting parameter to the first digital-to-analog conversion sub-circuit 111*b*.

An output terminal of the first digital-to-analog conversion sub-circuit 111*b* is electrically coupled to an input terminal of the first operational amplifier 111*c*, a first reference terminal of the first digital-to-analog conversion sub-circuit 111*b* is configured to receive the reference voltage Vref, and a second reference terminal of the first digital-to-analog conversion sub-circuit is grounded, so that the first digital-to-analog conversion sub-circuit 111*b* can output an initial semi-analog supply voltage signal according to the semi-analog supply voltage setting parameter and the reference voltage Vref.

The input terminal of the first operational amplifier 111*c* is electrically coupled to the output terminal of the first digital-to-analog conversion sub-circuit 111*b*, a first reference terminal of the first operational amplifier 111*c* is electrically coupled to the initial voltage input terminal VIN, and a second reference terminal of the first operational amplifier 111*c* is grounded, so that the first operational amplifier 111*c* can output a secondary semi-analog supply voltage signal according to the initial semi-analog supply voltage signal and the initial voltage $V_{IN_GAMA}$.

A positive input terminal of the first comparator 111*d* is electrically coupled to an output terminal of the first operational amplifier 111*c*, a negative input terminal of the first comparator 111*d* is electrically coupled to a feedback voltage terminal HAVDD_FB, a first reference terminal of the first comparator 111*d* is electrically coupled to a built-in voltage input terminal SWI of an analog supply voltage sub-circuit, and a second reference terminal of the first comparator 111*d* is grounded, so that the first comparator 111*d* can output the semi-analog supply voltage HAVDD according to a built-in voltage provided by the built-in voltage input terminal SWI, the secondary semi-analog supply voltage signal, and a feedback signal output from the feedback voltage terminal HAVDD_FB.

In the embodiment of the present disclosure, the semi-analog supply voltage HAVDD can be generated merely by the first follower amplifier sub-circuit by using the built-in voltage and the initial voltage, which simplifies the structure of the power management device.

As an alternative implementation of the present disclosure, a drive enhancement transistor circuit (including a plurality of transistors operating in an amplification region) is externally attached and electrically coupled to an output terminal of the first comparator 111*d* to further amplify the voltage output by the first comparator 111*d*. In this way, the heat generated can be effectively transferred to the outside of the power management device while ensuring the drive capability of the semi-analog supply voltage.

In the present disclosure, the number of the gamma correction circuits is an even number, that is, the power management device includes 2N gamma correction circuits, N being a positive integer not less than 1. Among the 2N gamma correction circuits, the first N gamma correction circuits output positive voltages, and the last N gamma correction circuits output negative voltages. The semi-analog supply voltage HAVDD is between the $N^{th}$ gamma correction voltage and the $(N+1)^{th}$ gamma correction voltage. Therefore, in the process of generating the semi-analog supply voltage, a value of a setting parameter corresponding to the $N^{th}$ gamma correction circuit and a value of a setting parameter corresponding to the $(N+1)^{th}$ gamma correction circuit need to be referred to.

The first follower amplifier sub-circuit may further include a parameter setting sub-circuit 111*e*. One input terminal of the parameter setting sub-circuit 111*e* is configured to receive a user code input by a user, and the other input terminal of the parameter setting sub-circuit 111*e* is configured to receive the input of one half of a sum of the value of the setting parameter corresponding to the $N^{th}$ gamma correction circuit and the value of the setting parameter corresponding to the $(N+1)^{th}$ gamma correction circuit.

An output terminal of the parameter setting sub-circuit 111*e* is electrically coupled to an input terminal of the first parameter register 111*a*, so as to generate the parameter used by the first parameter register according to the user code and the value received by the other input terminal of the parameter setting sub-circuit.

Optionally, the first follower amplifier sub-circuit 111 may further include a parameter setting sub-circuit 111*e*. One input terminal of the parameter setting sub-circuit 111*e* is configured to receive a user code input by a user, and the other input terminal of the parameter setting sub-circuit 111*e* is configured to receive the input of one half of a sum of a value (denoted by G5 in the drawings) of a setting parameter corresponding to the fifth gamma correction circuit and a value (denoted by G6 in the drawings) of a setting parameter corresponding to the sixth gamma correction circuit.

Specifically, in the case where the power management device includes 10 gamma correction circuits, the first five gamma correction circuits output positive voltages, and the last five gamma correction circuits output negative voltages. The semi-analog supply voltage HAVDD is between the fifth gamma correction voltage and the sixth gamma correction voltage. Therefore, in the process of generating the semi-analog supply voltage, one half of the sum of the value (denoted by G5 in the drawings) of the setting parameter corresponding to the fifth gamma correction circuit and the value (denoted by G6 in the drawings) of the setting parameter corresponding to the sixth gamma correction circuit needs to be referred to.

Figure 6:
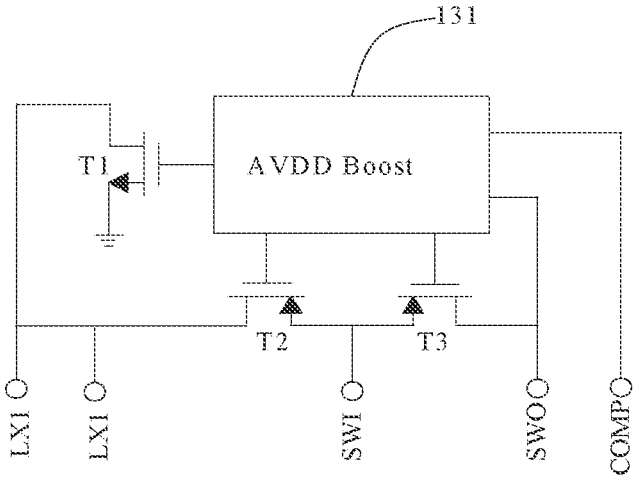
FIG. 6 is a schematic diagram of an analog supply voltage circuit in a power management device according to an embodiment of the present disclosure.

How to generate the analog supply voltage AVDD is not particularly limited in the present disclosure. As an alternative implementation of the present disclosure, as shown in FIG. 2, the power management device further includes an analog supply voltage circuit 130. As shown in FIGS. 2 and 6, the analog supply voltage circuit 130 includes a boost control sub-circuit 131, a first boost transistor T1, a second boost transistor T2, and a third boost transistor T3, the first boost transistor T1 being an N-type transistor, and the second boost transistor T2 and the third boost transistor T3 being P-type transistors.

As shown in FIG. 6, a first electrode of the first boost transistor T1 is electrically coupled to a pulse signal terminal LX1, a second electrode of the first boost transistor T1 is grounded, and a gate of the first boost transistor T1 is electrically coupled to a first output terminal of the boost control sub-circuit 131. The first output terminal of the boost control sub-circuit 131 is configured to output a first switch control signal which causes the first boost transistor T1 to operate in a switching region. That is, the first boost transistor T1 serves as a switching transistor.

A first electrode of the second boost transistor T2 is electrically coupled to a pulse signal terminal LX1, a second electrode of the second boost transistor T2 is electrically coupled to the built-in voltage input terminal SWI, and a gate of the second boost transistor T2 is electrically coupled to a second output terminal of the boost control sub-circuit 131. The second output terminal of the boost control sub-circuit 131 is configured to output a second switch control signal which controls the second boost transistor T2 to operate in a switching region. That is, the second boost transistor T2 serves as a switching transistor.

A first electrode of the third boost transistor T3 is electrically coupled to the built-in voltage input terminal SWI, a second electrode of the third boost transistor T3 is electrically coupled to a power output terminal SWO, and a gate of the third boost transistor T3 is electrically coupled to a third output terminal of the boost control sub-circuit 131. The third output terminal of the boost control sub-circuit 131 is configured to provide, to the third boost transistor T3, an amplification control signal which causes the third boost transistor T3 to operate in an amplification region.

A compensation terminal of the boost control sub-circuit 131 is electrically coupled to a compensation signal input terminal COMP, and a fourth output terminal of the boost control sub-circuit 131 is electrically coupled to the power output terminal SWO, so that the fourth output terminal can output the analog supply voltage AVDD under the control of the first boost transistor T1, the second boost transistor T2, the third boost transistor T3, pulse signals input from the pulse signal input terminals LX1, a built-in voltage input from the built-in voltage input terminal SWI, and a compensation voltage input from the compensation signal input terminal.

It should be noted that a main function of the first boost transistor T1 and the second boost transistor T2, which serve as the switching transistors, is to adjust the waveform of the analog supply voltage AVDD. A main function of the third boost transistor T3 is to control the magnitude of the analog supply voltage AVDD.

Specifically, waveforms of the pulse signals input from the pulse signal input terminals LX1 may be changed by controlling w % ben the first boost transistor T1 is turned on and how long the first boost transistor T1 remains in an on state, and the analog supply voltage AVDD is finally obtained by superposing the built-in voltage input from the built-in voltage input terminal SWI and the second boost transistor T2 and the pulse signals the waveforms of which have been adjusted.

It should be noted that although two pulse signal input terminals LX1 are provided in the specific implementation illustrated in FIG. 6, the two pulse signal input terminals LX1 are electrically coupled to each other, and are supplied with the same signals. With the arrangement of the two pulse signal terminals LX1, the input pulse signals are more stable. In some embodiments, only one pulse signal terminal LX1 may be provided.

The analog supply voltage circuit 130 provided by the present disclosure can supply an analog supply voltage of 35V, which can meet the requirements on voltage of a shift register circuit (GOA, Gate On Array) in an ultra high definition (UHD) display device. In the related art, an analog supply voltage can only reach 17V, and there is a problem of insufficient high-level voltage margin (VGH Margin). Such problem is solved by the analog supply voltage circuit 130 of the present disclosure.

As described above, the target operating voltage further includes the common voltage VCOM. Correspondingly, the at least one follower amplifier sub-circuit includes a second follower amplifier sub-circuit 112 configured to output the common voltage VCOM, and the target operating voltage setting parameter may further include a common voltage setting parameter.

Figure 5:
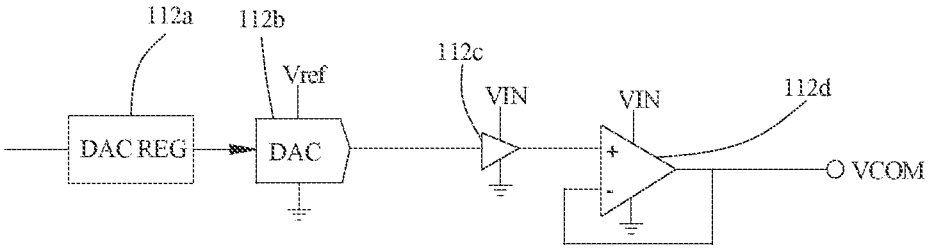
FIG. 5 is a schematic diagram of a common voltage generation sub-circuit in a power management device according to an embodiment of the present disclosure.

As shown in FIGS. 2 and 5, the second follower amplifier sub-circuit 112 includes a common voltage parameter register 112*a*, a second digital-to-analog conversion sub-circuit 112*b*, a second operational amplifier 112*c*, and a second comparator 112*d*.

An output terminal of the common voltage parameter register 112*a* is electrically coupled to an input terminal of the second digital-to-analog conversion sub-circuit 112*b* to provide the common voltage setting parameter to the second digital-to-analog conversion sub-circuit 112*b*. A first reference terminal of the second digital-to-analog conversion sub-circuit 112*b* is configured to receive the reference voltage Vref, and a second reference terminal of the second digital-to-analog conversion sub-circuit 112*b* is grounded, so as to output a primary common voltage according to the common voltage setting parameter and the reference voltage Vref.

An output terminal of the second digital-to-analog conversion sub-circuit 112*b* is electrically coupled to an input terminal of the second operational amplifier 112*c* to output the primary common voltage to the second operational amplifier 112*c*. A first reference terminal of the second operational amplifier 112*c* is configured to receive the initial voltage VIN, and a second reference terminal of the second operational amplifier 112*c* is grounded, so that the second operational amplifier 112*c* can output a secondary common voltage according to the primary common voltage and the initial voltage $V_{IN_GAMA}$.

An output terminal of the second operational amplifier 112*c* is electrically coupled to a positive input terminal of the second comparator 112*d* to provide the secondary common voltage to the positive input terminal of the second operational amplifier 112*c*.

A negative input terminal of the second comparator 112*d* is electrically coupled to an output terminal of the second comparator 112*d*, a first reference terminal of the second comparator 112*d* is electrically coupled to the initial voltage input terminal VIN, and a second reference terminal of the second comparator 112*d* is grounded, so that the second comparator 112*d* can output the common voltage VCOM according to the secondary common voltage and the initial voltage $V_{IN_GAMA}$.

In the present disclosure, the primary common voltage can be amplified by the second operational amplifier 112*c*, and the following of the common voltage can be achieved by the second comparator 112*d*.

As described above, the second follower amplifier sub-circuit can output the common voltage VCOM merely through the second operational amplifier 112*c* and the second comparator 112*d*, and thus is simple in structure and easy for implementation.

How to generate a high level signal VGH is not particularly limited in the present disclosure. Optionally, the high level signal VGH may be generated by using a positive charge pump and peripheral circuits matched with the positive charge pump.

Figure 7:
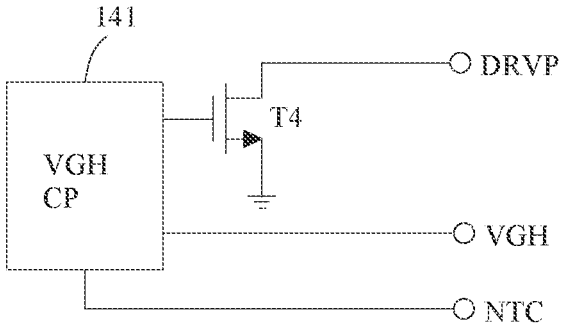
FIG. 7 is a schematic diagram of a high level generation sub-circuit in a power management device according to an embodiment of the present disclosure.

Specifically, as shown in FIGS. 2 and 7, the power management device further includes a high level generation sub-circuit 140 including a positive charge pump (VGH CP) 141 and a high level generation transistor T4, the high level generation transistor T4 being an N-type transistor.

A first electrode of the high level generation transistor T4 is electrically coupled to a positive drive signal terminal DRVP (Drive Positive), a second electrode of the high level generation transistor T4 is grounded, and a gate of the high level generation transistor T4 is electrically coupled to a first output terminal of the positive charge pump 141. The first output terminal of the positive charge pump 141 is configured to output a first control signal which controls the high level generation transistor T4 to operate in an amplification region.

A second output terminal of the positive charge pump 141 is configured to output a high level signal VGH. Specifically, the positive charge pump 141 outputs the high level signal VGH from the second output terminal thereof under the action of the high level generation transistor T4 and a positive drive signal (i.e., a positive voltage) input from the positive drive signal terminal DRVP.

With the arrangement of the N-type high level generation transistor T4, the output drive capability of the high level generation sub-circuit 140 can be enhanced, and a range of the output voltage of the high level generation sub-circuit 140 can be adjusted. The positive drive signal (i.e., the positive voltage) provided through the positive drive signal terminal DRVP controls the current passing capability of a circuit outside the power management device, and the output voltage can be controlled by electrically coupling the first electrode of the high level generation transistor T4 to the positive drive signal terminal DRVP.

In the present disclosure, the high level signal can be generated by the positive charge pump 141, without using the analog supply voltage AVDD, so that the high level signal VGH can be high enough. Further, the generation of the high level signal VGH does not involve the power management circuit or the gamma correction circuits, and does not depend on the analog supply voltage AVDD. Therefore, the magnitude of the analog supply voltage AVDD can be decreased in the present disclosure, thereby reducing the heat generated by the power management device.

An internal circuit of the positive charge pump 141 includes a plurality of transistors. As an alternative implementation of the present disclosure, the high level generation sub-circuit 140 further includes a temperature compensation controller NTC configured to generate, according to a temperature of the high level generation sub-circuit, a temperature compensation signal which controls the output voltage of the positive charge pump 141. With the arrangement of the temperature compensation controller NTC, the inaccuracy of the output voltage of the positive charge pump 141, which is a result of a voltage drift caused by a temperature rise in the operation, can be reduced or even avoided.

Figure 8:
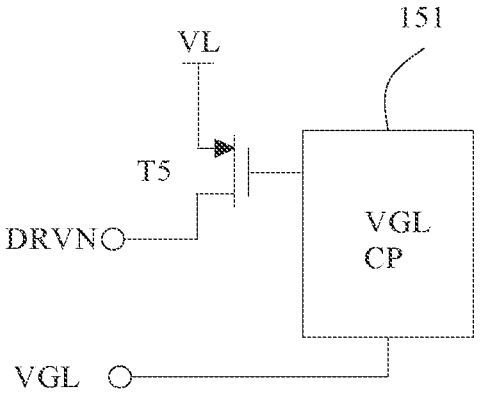
FIG. 8 is a schematic diagram of a low level generation sub-circuit in a power management device according to an embodiment of the present disclosure.

As an implementation of the present disclosure, as shown in FIGS. 2 and 8, the power management device may further include a low level generation sub-circuit 150 including a negative charge pump 151 and a low level generation transistor T5, the low level generation transistor T5 being a P-type transistor.

A gate of the low level generation transistor T5 is electrically coupled to a first output terminal of the negative charge pump (VGL CP) 151, a first electrode of the low level generation transistor T5 is electrically coupled to a voltage level terminal VL, and a second electrode of the low level generation transistor T5 is electrically coupled to a negative drive signal terminal DRVN (Drive Negative). The first output terminal of the negative charge pump 151 is configured to output a second control signal which controls the low level generation transistor T5 to be in an amplification region.

An output terminal of the negative charge pump 151 is configured to output a low level signal VGL. Specifically, the negative charge pump 151 is configured to output the low level signal VGL from a second output terminal thereof under the action of the low level generation transistor T5 and a negative drive signal input from the negative drive signal terminal DRVN.

Since both the power management circuit 110 and the gamma correction circuits 120 generate the corresponding signals by use of the reference voltage Vref and the initial voltage $V_{IN_GAMA}$, the power management circuit 110 and the gamma correction circuits 120 may be integrated in the same power management chip for ease of manufacturing.

As an alternative implementation of the present disclosure, the power management device may further include a low-dropout regulator (LDO) 300 externally attached to the power management chip. The low-dropout regulator is configured to generate a driving voltage) according to a switching signal BK1. As an optional implementation, the switching signal BK1 may have a voltage of 3.3V, and the driving voltage for driving an ultra high definition serial digital interface (UHD-SID) may be 1.8V.

Neither high definition (HD) display devices nor full high definition (FHD) display devices are provided with a UHD serial digital interface. When the power management device provided by the present disclosure is applied to an HD or FHD display device, the low-dropout regulator 300, which is externally attached to the power management chip, may be removed, so that the power management device provided by the present disclosure can be compatible with display devices with various resolutions.

As an alternative implementation of the present disclosure, the power management device may further include a first buck chopper circuit (i.e., a buck circuit) 200, which is externally attached to the power management chip, and is configured to generate a first low voltage according to the initial voltage $V_{IN_GAMA}$. According to an optional implementation, the initial voltage $V_{IN_GAMA}$ is 3.3V, and the first low voltage of 1.2V may be generated by the first buck chopper circuit 200. The first low voltage may be used as a core voltage of a timing control chip (T-con).

How to generate the switching signal BK1 and the voltage level VL is not particularly limited in the present disclosure. According to an optional implementation of the present disclosure, the switching signal BK1 and the voltage level VL may be generated by a second buck chopper circuit 160.

Figure 9:
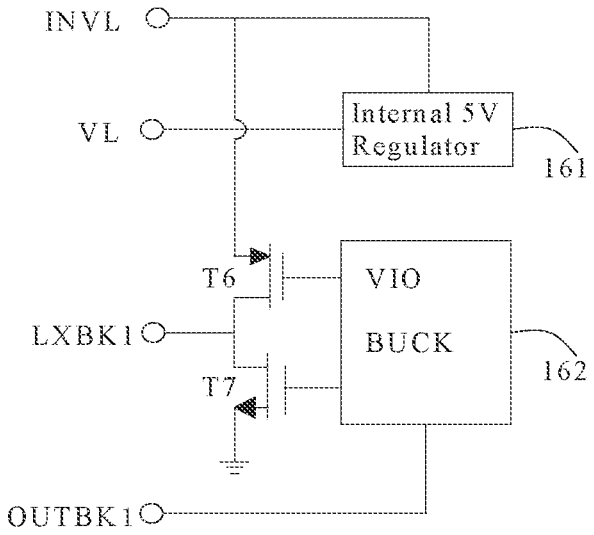
FIG. 9 is a schematic diagram of a second buck chopper circuit in a power management device according to an embodiment of the present disclosure.

Specifically, as shown in FIGS. 2 and 9, the second buck chopper circuit 160 includes an internal regulator sub-circuit 161, a buck chopping control sub-circuit 162, a sixth transistor T6, and a seventh transistor T7, the sixth transistor T6 being a P-type transistor, and the seventh transistor T7 being an N-type transistor.

The internal regulator sub-circuit 161 is configured to generate the voltage level VL according to an input voltage INVL. For example, the internal regulator sub-circuit 161 may be an internal 5V regulator, which can regulate an input voltage INVL of 5V to the voltage level VL.

A first electrode of the sixth transistor T6 is electrically coupled to the input voltage INVL, a second electrode of the sixth transistor T6 is electrically coupled to a switching signal output terminal LXBK1, a gate of the sixth transistor T6 is electrically coupled to a first output terminal of the buck chopping control sub-circuit 162, and the first output terminal of the buck chopping control sub-circuit 162 is configured to output a first buck chopping control signal which controls the sixth transistor to operate in a switching operation region. That is, the sixth transistor T6 herein serves as a switching transistor.

A first electrode of the seventh transistor 17 is electrically coupled to the switching signal output terminal LXBK1, a second electrode of the seventh transistor T7 is grounded, a gate of the seventh transistor T7 is electrically coupled to a second output terminal of the buck chopping control sub-circuit 162, and the second output terminal of the buck chopping control sub-circuit 162 is configured to output a second buck chopping control signal which controls the seventh transistor T7 to operate in a switching operation region. That is, the seventh transistor T7 herein serves as a switching transistor.

The sixth transistor T6 and the seventh transistor T7 generate the switching signal BK1 from the input voltage INVL under the control of the first buck chopping control signal and the second buck chopping control signal. A waveform of the obtained switching signal BK1 is controlled mainly through the timing of the first buck chopping control signal and the timing the second buck chopping control signal.

Optionally, a compensation terminal of the buck chopping control sub-circuit 162 is electrically coupled to a sampling signal terminal OUTBK1 configured to sample the switching signal BK1, so that the first buck chopping control signal and/or the second buck chopping control signal are/is regulated according to the sampled switching signal, so as to control the waveform of the switching signal BK1.

Figure 10:
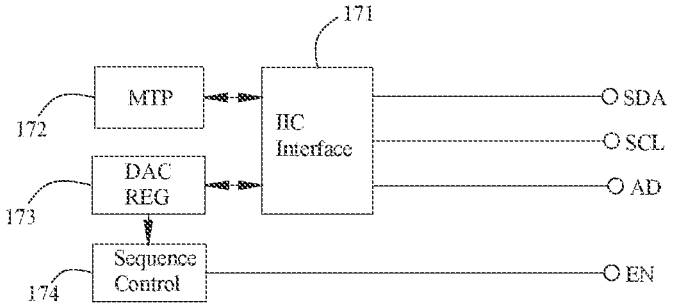
FIG. 10 is a schematic diagram of a communication sub-circuit in a power management device according to an embodiment of the present disclosure.

Optionally, the power management device may further include a communication sub-circuit 170. As shown in FIGS. 2 and 10, the communication sub-circuit includes a two-wire serial bus interface (IIC) 171, a media transfer protocol (MTP) memory sub-circuit 172, a digital-to-analog conversion register (DAC REG) 173, and a sequence control sub-circuit 174.

As shown in FIG. 10, the MTP memory sub-circuit may communicate with the two-wire serial bus interface 171, the digital-to-analog conversion register 173 communicates with the two-wire serial bus interface 171, and an output terminal of the digital-to-analog conversion register 173 is electrically coupled to an input terminal of the sequence control sub-circuit 174.

The communication sub-circuit 170 may communicate with the outside of the power control module via the IIC protocol. The two-wire serial bus interface 171 is composed of two signal lines, namely, a clock line SCL and a bidirectional data line SDA; and the two-wire serial bus interface 171 is further provided with an analog signal input port AD. Various externally written parameters can be received through the two-wire serial bus interface 171, stored in the digital-to-analog conversion register 173, and sequentially distributed to the circuits of the power management device under the control of the sequence control sub-circuit 174.

It should be noted that the above action of distributing parameters is performed when an enable signal is received by an enable control terminal EN of the sequence control sub-circuit 174.

In a second aspect of the present disclosure, there is provided a display device, including a display panel and a power management device. The display panel includes a pixel driving circuit configured to drive the display panel to display upon receipt of a target voltage. The power management device is the above power management device provided by the present disclosure and is configured to provide the target voltage and the gamma correction voltage.

As described above, the power management circuit 110 outputs the target operating voltage through the follower amplifier sub-circuit. The follower amplifier sub-circuit has a simple circuit structure, which allows integration of the plurality of gamma correction circuits 120 in the power management circuit 110, thereby facilitating making a display device including the power management device small and light.

It should be understood that the above implementations are merely exemplary implementation employed to illustrate the principles of the present disclosure, and the present disclosure is not limited thereto. Without departing from the spirit and essence of the present disclosure, various changes and modifications may be made by those skilled in the art, and these changes and modifications should be considered to fall within the scope of the present disclosure.

What is claimed is:

1. A power management device, comprising an initial voltage input terminal, a power management circuit, and a plurality of gamma correction circuits, wherein the initial voltage input terminal is configured to provide an initial voltage;

the power management circuit comprises at least one follower amplifier sub-circuit, each follower amplifier sub-circuit is configured to output a corresponding target operating voltage according to the initial voltage, a reference voltage, and a target operating voltage setting parameter; and each gamma correction circuit is configured to output a corresponding gamma correction voltage according to the initial voltage, the reference voltage, and a gamma parameter, wherein the gamma correction circuit comprises a gamma parameter register sub-circuit, a gamma correction digital-to-analog conversion sub-circuit, and a gamma correction operational amplifier;

an output terminal of the gamma parameter register sub-circuit is electrically coupled to an input terminal of the gamma correction digital-to-analog conversion sub-circuit, so as to provide the gamma parameter to the gamma correction digital-to-analog conversion sub-circuit;

a first reference terminal of the gamma correction digital-to-analog conversion sub-circuit is configured to receive the reference voltage, and a second reference terminal of the gamma correction digital-to-analog conversion sub-circuit is grounded, so as to allow the gamma correction digital-to-analog conversion sub-circuit to output an initial gamma analog signal according to the reference voltage and the gamma parameter; and an input terminal of the gamma correction operational amplifier is electrically coupled to an output terminal of the gamma correction digital-to-analog conversion sub-circuit, a first reference terminal of the gamma correction operational amplifier is electrically coupled to the initial voltage input terminal, and a second reference terminal of the gamma correction operational amplifier is grounded, so as to allow the gamma correction operational amplifier to output the gamma correction voltage according to the initial gamma analog signal and the initial voltage.

2. The power management device of claim 1, further comprising a reference voltage generation sub-circuit configured to generate the reference voltage according to the initial voltage provided by the initial voltage input terminal.

3. The power management device of claim 1, comprising 10 gamma correction circuits.

4. The power management device of claim 1, wherein the target operating voltage comprises a semi-analog supply voltage, the target operating voltage setting parameter comprises a semi-analog supply voltage setting parameter, and the at least one follower amplifier sub-circuit comprises a first follower amplifier sub-circuit configured to output the semi-analog supply voltage;

the first follower amplifier sub-circuit comprises a first parameter register, a first digital-to-analog conversion sub-circuit, a first operational amplifier, and a first comparator;

an output terminal of the first parameter register is electrically coupled to an input terminal of the first digital-to-analog conversion sub-circuit, so as to provide the semi-analog supply voltage setting parameter to the first digital-to-analog conversion sub-circuit;

an output terminal of the first digital-to-analog conversion sub-circuit is electrically coupled to an input terminal of the first operational amplifier, a first reference terminal of the first digital-to-analog conversion sub-circuit is configured to receive the reference voltage, and a second reference terminal of the first digital-to-analog conversion sub-circuit is grounded, so as to allow the first digital-to-analog conversion sub-circuit to output an initial semi-analog supply voltage signal according to the semi-analog supply voltage setting parameter and the reference voltage;

the input terminal of the first operational amplifier is electrically coupled to the output terminal of the first digital-to-analog conversion sub-circuit, a first reference terminal of the first operational amplifier is electrically coupled to the initial voltage input terminal, and a second reference terminal of the first operational amplifier is grounded, so as to allow the first operational amplifier to output a secondary semi-analog supply voltage signal according to the initial semi-analog supply voltage signal and the initial voltage; and a positive input terminal of the first comparator is electrically coupled to an output terminal of the first operational amplifier, a negative input terminal of the first comparator is electrically coupled to a feedback voltage terminal, a first reference terminal of the first comparator is electrically coupled to a built-in voltage input terminal, and a second reference terminal of the first comparator is grounded, so as to allow the first comparator to output the semi-analog supply voltage according to a built-in voltage provided through the built-in voltage input terminal, the secondary semi-analog supply voltage signal, and a feedback signal output from the feedback voltage terminal.

5. The power management device of claim 4, wherein the power management device comprises 2N gamma correction circuits, N being a positive integer not less than 1, the first follower amplifier sub-circuit further includes a parameter setting sub-circuit, one input terminal of the parameter setting sub-circuit is configured to receive a user code input by a user, and the other input terminal of the parameter setting sub-circuit is configured to receive the input of one half of a sum of a value of a setting parameter corresponding to the $N^{th}$ gamma correction circuit and a value of a setting parameter corresponding to the $(N+1)^{th}$ gamma correction circuit; and an output terminal of the parameter setting sub-circuit is electrically coupled to an input terminal of the first parameter register, so as to generate, according to the user code and the value received by the other input terminal of the parameter setting sub-circuit, the parameter used by the first parameter register.

6. The power management device of claim 4, further comprising an analog supply voltage circuit, wherein the analog supply voltage circuit comprises a boost control sub-circuit, a first boost transistor, a second boost transistor, and a third boost transistor, the first boost transistor being an N-type transistor, and the second boost transistor and the third boost transistor being P-type transistors, a first electrode of the first boost transistor is electrically coupled to a pulse signal terminal, a second electrode of the first boost transistor is grounded, a gate of the first boost transistor is electrically coupled to a first output terminal of the boost control sub-circuit, and the first output terminal of the boost control sub-circuit is configured to output a first switch control signal which makes the first boost transistor operate in a switching region;

a first electrode of the second boost transistor is electrically coupled to the pulse signal terminal, a second electrode of the second boost transistor is electrically coupled to the built-in voltage input terminal, a gate of the second boost transistor is electrically coupled to a second output terminal of the boost control sub-circuit, and the second output terminal of the boost control sub-circuit is configured to output a second switch control signal which controls the second boost transistor to operate in the switching region;

a first electrode of the third boost transistor is electrically coupled to the built-in voltage input terminal, a second electrode of the third boost transistor is electrically coupled to a power output terminal, a gate of the third boost transistor is electrically coupled to a third output terminal of the boost control sub-circuit, and the third output terminal of the boost control sub-circuit is configured to provide, to the third boost transistor, an amplification control signal which makes the third boost transistor operate in an amplification region; and a compensation terminal of the boost control sub-circuit is electrically coupled to a compensation signal input terminal, and a fourth output terminal of the boost control sub-circuit is electrically coupled to the power output terminal, so as to allow the fourth output terminal to output the analog supply voltage under the control of the first boost transistor, the second boost transistor, the third boost transistor, a pulse signal input from the pulse signal input terminal, a built-in voltage input from the built-in voltage input terminal, and a compensation voltage input from the compensation signal input terminal.

7. The power management device of claim 1, wherein the target voltage further comprises a common voltage, the at least one follower amplifier sub-circuit comprises a second follower amplifier sub-circuit configured to output the common voltage, and the target operating voltage setting parameter comprises a common voltage setting parameter, the second follower amplifier sub-circuit comprises a common voltage parameter register, a second digital-to-analog conversion sub-circuit, a second operational amplifier, and a second comparator, an output terminal of the common voltage parameter register is electrically coupled to an input terminal of the second digital-to-analog conversion sub-circuit, so as to provide the common voltage setting parameter to the second digital-to-analog conversion sub-circuit;

a first reference terminal of the second digital-to-analog conversion sub-circuit is configured to receive the reference voltage, and a second reference terminal of the second digital-to-analog conversion sub-circuit is grounded, so as to output a primary common voltage according to the common voltage setting parameter and the reference voltage, and an output terminal of the second digital-to-analog conversion sub-circuit is electrically coupled to an input terminal of the second operational amplifier;

a first reference terminal of the second operational amplifier is electrically coupled to the initial voltage input terminal, a second reference terminal of the second operational amplifier is grounded, and an output terminal of the second operational amplifier is electrically coupled to a positive input terminal of the second comparator, so as to allow the second operational amplifier to output a secondary common voltage according to the primary common voltage and the initial voltage; and the positive input terminal of the second comparator is electrically coupled to the output terminal of the second operational amplifier, a negative input terminal of the second comparator is electrically coupled to an output terminal of the second comparator, a first reference terminal of the second comparator is electrically coupled to the initial voltage input terminal, and a second reference terminal of the second comparator is grounded, so as to allow the second comparator to output the common voltage according to the secondary common voltage and the initial voltage.

8. The power management device of claim 1, further comprising a high level generation sub-circuit comprising a positive charge pump and a high level generation transistor, the high level generation transistor being an N-type transistor, wherein a first electrode of the high level generation transistor is electrically coupled to a positive drive signal terminal, a second electrode of the high level generation transistor is grounded, a gate of the high level generation transistor is electrically coupled to a first output terminal of the positive charge pump, and the first output terminal of the positive charge pump is configured to output a first control signal which controls the high level generation transistor to be in an amplification region; and the positive charge pump is further configured to output a high level signal from a second output terminal thereof under the action of the high level generation transistor and a positive drive signal input from the positive drive signal terminal.

9. The power management device of claim 8, wherein the high level generation sub-circuit further comprises a temperature compensation controller configured to generate, according to a temperature of the high level generation sub-circuit, a temperature compensation signal which controls the high level signal output from the second output terminal of the positive charge pump.

10. The power management device of claim 1, further comprising a low level generation sub-circuit comprising a negative charge pump and a low level generation transistor, the low level generation transistor being a P-type transistor, wherein a gate of the low level generation transistor is electrically coupled to a first output terminal of the negative charge pump, a first electrode of the low level generation transistor is electrically coupled to a voltage level terminal, a second electrode of the low level generation transistor is electrically coupled to a negative drive signal terminal, and the first output terminal of the negative charge pump is configured to output a second control signal which controls the low level generation transistor to be in an amplification region; and the negative charge pump is further configured to output a low level signal from a second output terminal thereof under the action of the low level generation transistor and a negative drive signal input from the negative drive signal terminal.

11. The power management device of claim 1, wherein the power management circuit and the plurality of gamma correction circuits are integrated in a same power management chip.

12. The power management device of claim 11, further comprising a low-dropout regulator circuit externally attached to the power management chip and configured to generate a driving voltage for driving an ultra high definition serial digital interface according to a switching signal.

13. The power management device of claim 11, further comprising a first buck chopper circuit externally attached to the power management chip and configured to generate a first low voltage according to the initial voltage, the first low voltage being configured to supply power to a timing control chip.

14. The power management device of claim 1, further comprising a second buck chopper circuit, wherein the second buck chopper circuit comprises an internal regulator sub-circuit, a buck chopping control sub-circuit, a sixth transistor, and a seventh transistor, the sixth transistor being a P-type transistor, and the seventh transistor being an N-type transistor;

the internal regulator sub-circuit is configured to generate a voltage level according to an input voltage;

a first electrode of the sixth transistor is electrically coupled to the input voltage, a second electrode of the sixth transistor is electrically coupled to a switching signal output terminal, a gate of the sixth transistor is electrically coupled to a first output terminal of the buck chopping control sub-circuit, and the first output terminal of the buck chopping control sub-circuit is configured to output a first buck chopping control signal which controls the sixth transistor to operate in a switching operation region;

a first electrode of the seventh transistor is electrically coupled to the switching signal output terminal, a second electrode of the seventh transistor is grounded, a gate of the seventh transistor is electrically coupled to a second output terminal of the buck chopping control sub-circuit, and the second output terminal of the buck chopping control sub-circuit is configured to output a second buck chopping control signal which controls the seventh transistor to operate in the switching operation region; and the sixth transistor and the seventh transistor generate the switching signal from the input voltage under the control of the first buck chopping control signal and the second buck chopping control signal.

15. The power management device of claim 14, wherein a compensation terminal of the buck chopping control sub-circuit is electrically coupled to a sampling signal terminal, the sampling signal terminal is configured to sample the switching signal to regulate the first buck chopping control signal and/or the second buck chopping control signal through the sampled switching signal, so as to control a waveform of the switching signal.

16. A display device, comprising a display panel and a power management device, the display panel comprising a pixel driving circuit configured to drive the display panel to display upon receipt of a target voltage, wherein the power management device comprises an initial voltage input terminal, a power management circuit, and a plurality of gamma correction circuits, wherein the initial voltage input terminal is configured to provide an initial voltage;

the power management circuit comprises at least one follower amplifier sub-circuit, each follower amplifier sub-circuit is configured to output a corresponding target operating voltage according to the initial voltage, a reference voltage, and a target operating voltage setting parameter; and each gamma correction circuit is configured to output a corresponding gamma correction voltage according to the initial voltage, the reference voltage, and a gamma parameter, wherein the gamma correction circuit comprises a gamma parameter register sub-circuit, a gamma correction digital-to-analog conversion sub-circuit, and a gamma correction operational amplifier;

an output terminal of the gamma parameter register sub-circuit is electrically coupled to an input terminal of the gamma correction digital-to-analog conversion sub-circuit, so as to provide the gamma parameter to the gamma correction digital-to-analog conversion sub-circuit;

a first reference terminal of the gamma correction digital-to-analog conversion sub-circuit is configured to receive the reference voltage, and a second reference terminal of the gamma correction digital-to-analog conversion sub-circuit is grounded, so as to allow the gamma correction digital-to-analog conversion sub-circuit to output an initial gamma analog signal according to the reference voltage and the gamma parameter; and an input terminal of the gamma correction operational amplifier is electrically coupled to an output terminal of the gamma correction digital-to-analog conversion sub-circuit, a first reference terminal of the gamma correction operational amplifier is electrically coupled to the initial voltage input terminal, and a second reference terminal of the gamma correction operational amplifier is grounded, so as to allow the gamma correction operational amplifier to output the gamma correction voltage according to the initial gamma analog signal and the initial voltage.

17. A power management device, comprising an initial voltage input terminal, a power management circuit, and a plurality of gamma correction circuits, wherein the initial voltage input terminal is configured to provide an initial voltage;

the power management circuit comprises at least one follower amplifier sub-circuit, each follower amplifier sub-circuit is configured to output a corresponding target operating voltage according to the initial voltage, a reference voltage, and a target operating voltage setting parameter; and each gamma correction circuit is configured to output a corresponding gamma correction voltage according to the initial voltage, the reference voltage, and a gamma parameter, wherein the target operating voltage comprises a semi-analog supply voltage, the target operating voltage setting parameter comprises a semi-analog supply voltage setting parameter, and the at least one follower amplifier sub-circuit comprises a first follower amplifier sub-circuit configured to output the semi-analog supply voltage;

the first follower amplifier sub-circuit comprises a first parameter register, a first digital-to-analog conversion sub-circuit, a first operational amplifier, and a first comparator;

an output terminal of the first parameter register is electrically coupled to an input terminal of the first digital-to-analog conversion sub-circuit, so as to provide the semi-analog supply voltage setting parameter to the first digital-to-analog conversion sub-circuit;

an output terminal of the first digital-to-analog conversion sub-circuit is electrically coupled to an input terminal of the first operational amplifier, a first reference terminal of the first digital-to-analog conversion sub-circuit is configured to receive the reference voltage, and a second reference terminal of the first digital-to-analog conversion sub-circuit is grounded, so as to allow the first digital-to-analog conversion sub-circuit to output an initial semi-analog supply voltage signal according to the semi-analog supply voltage setting parameter and the reference voltage;

the input terminal of the first operational amplifier is electrically coupled to the output terminal of the first digital-to-analog conversion sub-circuit, a first reference terminal of the first operational amplifier is electrically coupled to the initial voltage input terminal, and a second reference terminal of the first operational amplifier is grounded, so as to allow the first operational amplifier to output a secondary semi-analog supply voltage signal according to the initial semi-analog supply voltage signal and the initial voltage; and a positive input terminal of the first comparator is electrically coupled to an output terminal of the first operational amplifier, a negative input terminal of the first comparator is electrically coupled to a feedback voltage terminal, a first reference terminal of the first comparator is electrically coupled to a built-in voltage input terminal, and a second reference terminal of the first comparator is grounded, so as to allow the first comparator to output the semi-analog supply voltage according to a built-in voltage provided through the built-in voltage input terminal, the secondary semi-analog supply voltage signal, and a feedback signal output from the feedback voltage terminal.

* * * * *